US005317850A

United States Patent [19]

Colonias et al.

[11] Patent Number: 5,317,850

[45] Date of Patent: Jun. 7, 1994

[54] OFFSET ANCHOR BOLT AND METHOD OF ORIENTATION

[75] Inventors: Karen W. Colonias, Pleasant Hill; Thomas J. Fitzmyers, Pleasanton, both of Calif.

[73] Assignee: Simpson Strong-Tie Company, Inc., San Leandro, Calif.

[21] Appl. No.: 957,669

[22] Filed: Oct. 7, 1992

[51] Int. Cl.[5] ..... E04B 1/98

[52] U.S. Cl. ..... 52/293.3; 52/294; 52/295

[58] Field of Search ..... 52/293.3, 294, 295, 52/712, 709, 105

[56] References Cited

U.S. PATENT DOCUMENTS

| | | | |
|---|---|---|---|
| 919,771 | 4/1909 | Roberts | 52/295 |
| 1,339,226 | 5/1920 | Schuster | 52/105 X |
| 1,798,982 | 3/1931 | Ne Page | 52/295 |
| 1,834,535 | 12/1931 | Riemenschneider | 52/295 |
| 2,245,133 | 6/1941 | Hopkins | 52/105 X |
| 2,689,987 | 9/1954 | Berger | 52/293.3 |
| 3,334,455 | 8/1967 | Russell | 52/293.3 X |
| 3,391,515 | 7/1968 | Clay | 52/711 |
| 3,852,931 | 12/1974 | Morse | 52/293.3 |
| 3,889,439 | 6/1975 | Kaspar | 52/709 |
| 4,193,246 | 3/1980 | Schiefer | 52/698 |
| 4,195,709 | 4/1980 | Gianotti | 52/698 X |
| 4,655,014 | 4/1987 | Krecke | 52/105 |
| 4,665,672 | 5/1987 | Commins et al. | 52/295 |
| 4,736,554 | 4/1988 | Tyler | 52/295 X |
| 4,750,306 | 6/1988 | Granieri | 52/295 X |
| 4,817,353 | 4/1989 | Woods et al. | 52/295 |
| 4,872,298 | 10/1989 | Klemic | 52/295 X |
| 5,050,364 | 9/1991 | Johnson | 52/295 X |
| 5,060,436 | 10/1991 | Delgado | 52/295 |
| 5,060,447 | 10/1991 | Rinklake | 52/698 |
| 5,150,553 | 9/1992 | Commins | 52/295 X |
| 5,218,805 | 6/1993 | Rex | 52/295 |

OTHER PUBLICATIONS

P.11, Graphic Guide to Frame Construction, Rob Thallon, The Taunton Press, Inc. Copyright 1991.

P. 10, Simpson Strong-Tie Company, Inc. catalog copyright 1991.

*Primary Examiner*—Carl D. Friedman
*Assistant Examiner*—Beth A. Aubrey
*Attorney, Agent, or Firm*—James R. Cypher

[57] ABSTRACT

An anchor bolt connection in a framed building which includes a concrete foundation for supporting and anchoring a framed building against uplift forces and an anchor bolt for connecting the frame of the building to the concrete foundation. The anchor bolt is formed with an offset so that a substantial portion of the embedded portion of the anchor bolt is at an angle to the axis of the upper portion of the anchor bolt. In an optimum form of the invention, substantially all of the embedded portion of the anchor bolt is at an angle to the upper portion. In a preferred form of the anchor bolt connection, indicia marks are placed on the anchor bolt so that the rotational orientation of the anchor bolt can be inspected before, during and after the concrete is poured.

8 Claims, 2 Drawing Sheets

OFFSET ANCHOR BOLT AND METHOD OF ORIENTATION

BACKGROUND

In those areas of the country subject to earthquakes, hurricanes, tornadoes, floods, or tidal action which impose upward forces on building structures, it has become standard practice to tie the structure to the concrete foundation.

The oldest and probably still the most common practice is to set anchor bolts threaded at their upper end in the foundation. When the concrete has hardened, holes are drilled in the wood mudsill and the mudsill is placed on the foundation with the anchor bolts extending through the holes. A washer and nut are placed on the anchor bolt and the bolt tightened down to hold the mudsill to the foundation.

Anchor bolts are sold in basically four different configurations; viz. J-bolt, L-bolt, hex head bolt and threaded rod with two nuts and washer.

The early construction practice was to simply toe nail the studs to the wood mudsill. It was soon learned, however, that in too many instances after an earthquake or hurricane, that the mudsill stayed anchored to the foundation, but the toe nailed studs were unable to hold the frame of the house to the mudsill. Several types of metal connectors followed which connected the studs to the anchor bolt, culminating in the holdown disclosed in U.S. Pat. No. 4,665,672 granted May 19, 1987 to Alfred D. Commins, Tyrell T. Gilb, and Karen W. Colonias.

With increased loads being transferred to the foundation anchor bolt through holdowns connected to the framing studs, it became apparent that greater attention must be paid to the connection of the anchor bolt in the foundation.

Anchor bolts with end protrusions such as the J-bolt and L-bolt which have greater anchorage in the foundation than straight bolts, can only achieve the increased load anchorage if the end protrusions are located inwardly from the edge of the concrete. If for example, the end protrusion of the anchor bolt comes too close to the edge of the foundation, bursting of the side of the foundation can occur at less than design loads. Further, an anchor bolt which is very close to the edge of the concrete or even protrudes through the concrete is more subject to corrosion. There is presently no means, however, to determine the orientation of the bolt after the concrete has been poured and hardened. Inspection to determine proper orientation of prior art bolts is impossible.

Another problem with the prior art anchor bolts is that the portion of the bolt which extends vertically, whether it is a straight bolt, a J-bolt, or an L-bolt or any other configuration, contributes limited pull out resistance. Only the friction between the sides of the bolt and the concrete resists pull out in the vertical portion.

SUMMARY OF THE INVENTION

The present invention increases the resistance of the anchor bolt to pull out by eliminating virtually all vertical portions of the anchor bolt. This is achieved by forming an offset in the anchor bolt from the point of embedment to the end protrusion portion which can have any of a variety of configurations.

An additional feature of the present invention is that an indicia means is provided on the end portion protruding above the concrete indicating the direction of the offset.

The indicia means not only instructs the installer in the proper placement of the anchor bolt, but also provides a means for post pour inspection.

DESCRIPTION

Figure 1:
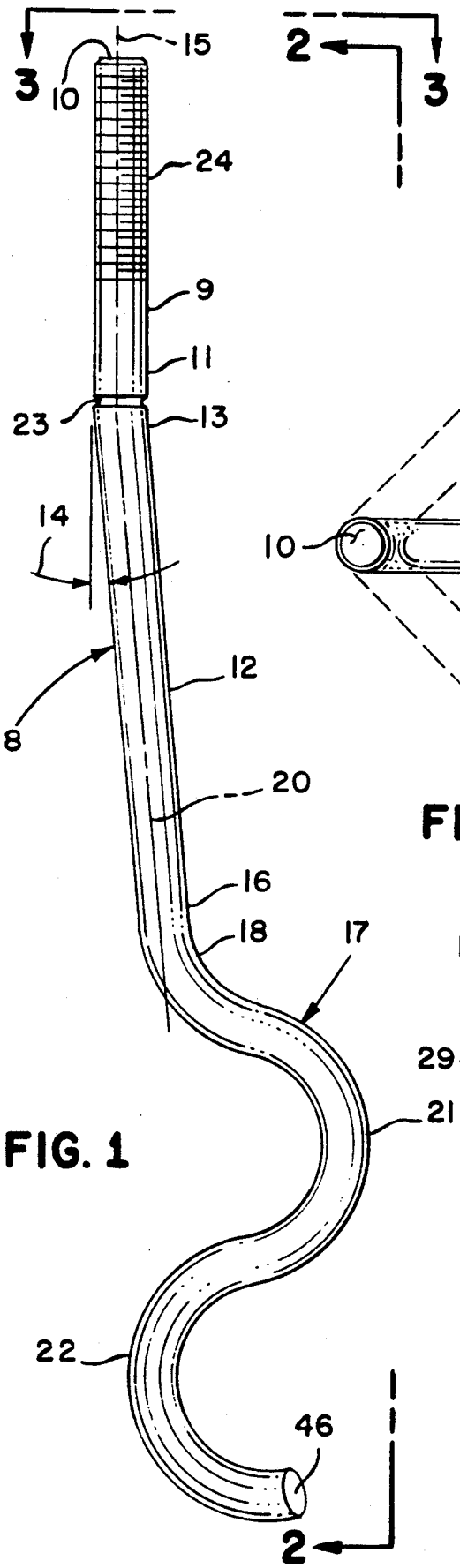
FIG. 1 is a front elevation view of an anchor bolt constructed in accordance with the present invention.
Figure 3:
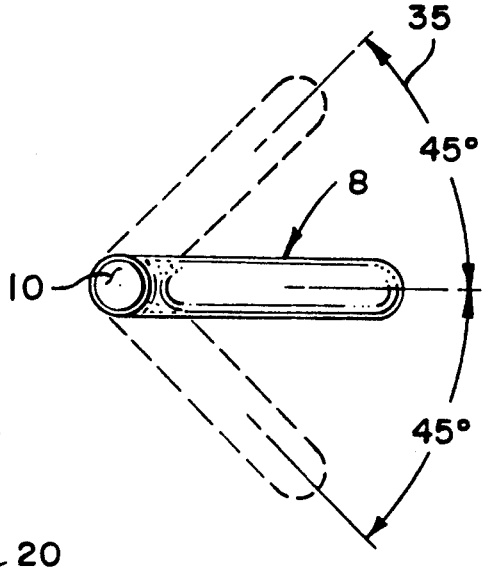
FIG. 3 is a top plan view of the anchor bolt illustrated in FIG. 1 taken along line 3—3. The broken lines illustrate the optimum orientation angles in which the anchor bolt may be placed.

The present invention is an anchor bolt connection 1 in a framed building 2 including: a concrete foundation 3 having a top surface 4, an outer wall 5, an inner wall 6 spaced from the outer wall 5, and a bottom wall 7 for supporting and anchoring the framed building 2 against uplift forces; and an anchor bolt 8 having an upper portion 9 adapted for connection to the framed building 2, and having an upper end 10 and a lower section 11, and a shank portion 12 having an upper section 13 integrally connected to the lower section 11 of the upper portion 9 substantially embedded in the foundation 3 and disposed at an offset angle 14 to the axis 15 of the upper portion 9.

The anchor bolt 8 as previously described includes an embedded end portion 17 having an upper section 18 integrally connected to the lower section 16 of the shank portion 12 formed to laterally protrude from the axis 20 of the shank portion 12.

Preferably, the anchor bolt 8 as previously described is configured so that the embedded end portion 17 forms a compound curve. One such compound curve is the letter "S" which includes upper section 18 formed in a curve, oppositely curved section 21 and distal oppositely curved section 22 terminating in distal end 46.

While it is not essential, the anchor bolt 8 previously described is most economically manufactured so that the portions of the anchor bolt 8 lie in substantially the same plane. This includes the upper portion 9, shank portion 12, and embedded end portion 17.

Another feature of the anchor bolt 8 previously described is the provision of an embedment indicia mark 23 indicating the embedment level of the anchor bolt in the concrete foundation.

The embedment indicia mark 23 is formed in the anchor bolt 8 at the intersection of the upper end portion 9 and the shank portion 12. Thus the installer should adjust the height of the anchor bolt 8 so that the embedment indicia mark 23 will occur at the design top surface 4 of the concrete foundation 3.

The upper portion 9 is preferably formed with a plurality of threads 24 adapted for receiving a threaded nut 25. In order to obtain maximum strength, the threads should be cold rolled rather than cut into the bolt.

Figure 8:
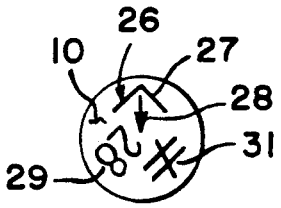
FIG. 8 is an enlarged view of the end of the anchor bolt illustrated in FIG. 2 taken along line 8—8 illustrating one form of indicia markings.
Figure 2:
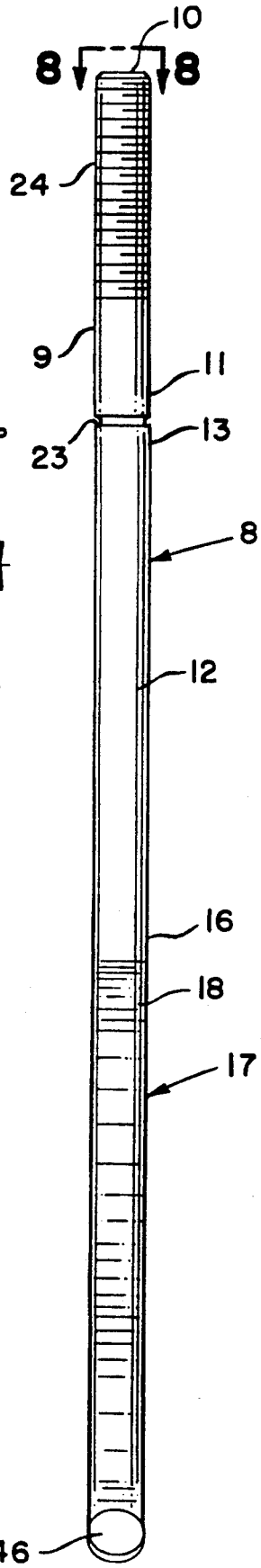
FIG. 2 is a side elevation view of the anchor bolt illustrated in FIG. 1 taken along line 2—2.

Referring to FIG. 8, orientation indicia means 26 is provided on anchor bolt 8 above the embedded portions 12 and 17 for visually orienting the anchor bolt 8 in relation to at least one of the walls 5 or 6 of the concrete foundation 3. Preferably, orientation indicia means 26 is inscribed in upper end 10 of the anchor bolt 8 so that the installer, owner, and building inspector can readily see the orientation indicia means 26 before and after the concrete has been poured. The orientation indicia means 26 may take various forms, one of which is illustrated and consists of a right angle 27 and an arrow 28 bisecting the right angle 27. Other indicia may be placed on upper end face 10 such as a number 29 which indicates the length of the anchor bolt 8 or other vital specification, and a trademark such as the Trademark symbol "≠" 31 which may be translated "there is no equal". Such trademarks indicate to the owner and the inspector that the installer installed the specified anchor bolt 8 in the concrete foundation or an accepted equivalent provided the "equivalent" anchor bolt is correctly inscribed. To summarize, the anchor bolt 8 of the present invention carries the following information: (1) the orientation indicia means 26 which indicates the orientation of the anchor bolt 8 in relation to either wall 5 or 6, the length of the anchor bolt 8 and the manufacturer of the anchor bolt 8.

The new method for constructing an anchor bolt connection 1 between a framed building 2 and a concrete foundation 3, includes the standard step of forming a foundation space 32 between at least two spaced form members 33 and 34 and the new steps of: 1). introducing an anchor bolt 8 into the foundation space 32 formed with an upper portion 9 adapted for connection to the framed building 2, a shank portion 12 embedded in the foundation 3 and disposed at an offset angle 14 to the upper portion 9, and orientation indicia means 26 provided on the anchor bolt 8 above the embedded portions 12 and 17 adapted for visually orienting the anchor bolt 8 in relation to the formed foundation space 32; 2). selecting an angular rotational position 35 of the anchor bolt 8 in the foundation space 32; and 3). holding the anchor bolt 8 in the selected rotational position 35 while pouring and the setting of the concrete foundation 3.

Figure 6:
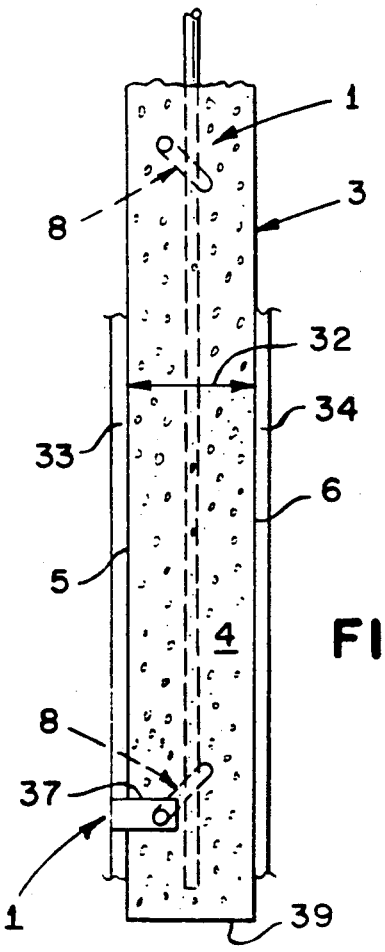
FIG. 6 is a top plan view of a foundation as illustrated in FIG. 4. The embedded anchor bolts and rebar are illustrated by broken lines.

The step of holding the anchor bolt 8 in a selected rotational position 35 could be accomplished by simply holding the anchor bolt with the hand while the concrete is poured. Several other methods could be used such as wiring the anchor bolt 8 to a rebar member 36 or clamping the anchor bolt 8 to a coupler 37 attached to the form member 33 as illustrated in FIG. 6.

Figure 7:
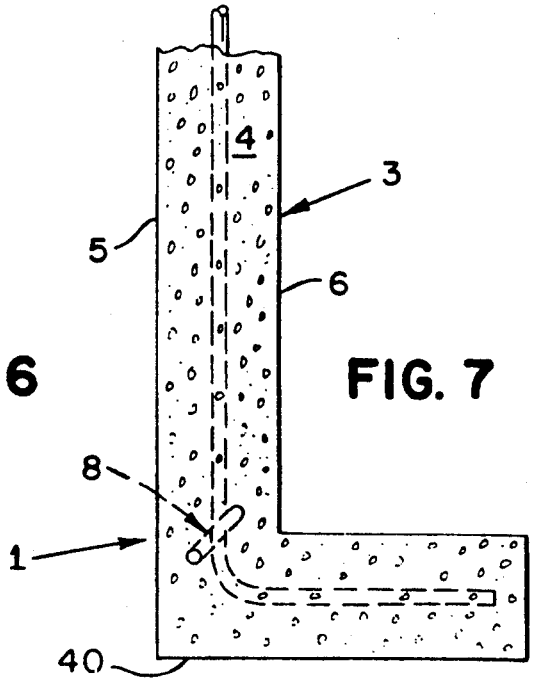
FIG. 7 is a top plan view of another foundation wall similar to the foundation wall illustrated in FIG. 4 except that foundation makes a corner. The anchor bolt and rebar are illustrated by broken lines.

Installation of the anchor bolt 8 to make the anchor bolt connection of the present invention is as follows. Form members 33 and 34 are placed to form the foundation space 32 by generally accepted construction means. Rebar members 36 and 38 are then placed according to the specifications. Anchor bolt 8 is then suspended in the foundation space 32 by a coupler 37 or other means so that the upper portion 9 is vertical and embedment indicator mark 23 is at the level of the top surface 4 of the concrete foundation 3. The anchor bolt 8 is then rotated so that the plane of the anchor bolt 8 is at an angle 35 to the outer wall 5 and inner wall 6 of the foundation 3. The optimum angle 35 is a 45° angle but good results have been obtained at angles between 35° and 45°. For best results, their should be a minimum of 1¾" between upper section 13 of the anchor bolt 8 and the outer wall face 5 and a minimum distance of 5" between the upper section 13 of the anchor bolt 8 and the end 39 of the concrete foundation 3 or the corner face 40 of a concrete foundation wall as shown in FIGS. 6 and 7.

Figure 5:
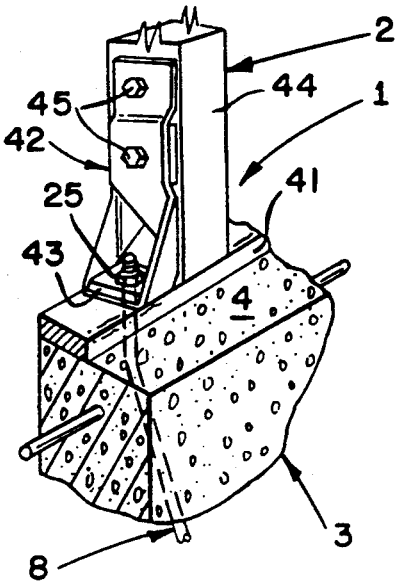
FIG. 5 is a perspective view of a portion of the concrete stem wall foundation illustrated in FIG. 4 illustrating a typical anchor bolt connection including a portion of the anchor bolt of the present invention, a typical commercial holdown and a typical stud in a wood frame building resting on a wood mudsill member.
Figure 4:
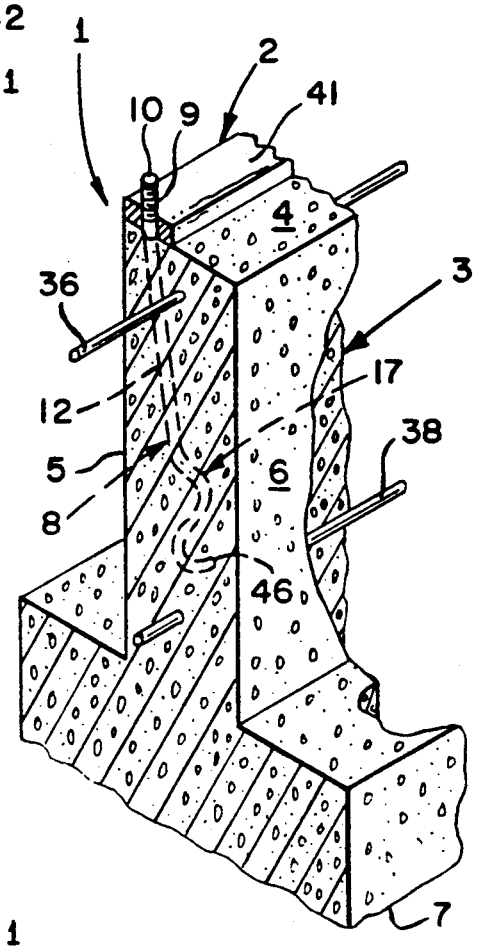
FIG. 4 is a perspective view of an anchor bolt as illustrated in FIG. 1 installed in a concrete stem wall foundation.

After the concrete has hardened and the form members 33 and 34 and coupler member 37 are removed, a mudsill 41 is placed on the top surface 4 so that the upper portion 9 of the anchor bolt 8 is inserted through bore holes and extends above the mudsill as illustrated in FIGS. 4 and 5. In a typical installation as illustrated in FIG. 5, a holdown 42 is installed so that the upper portion 9 of anchor bolt 8 protrudes through an opening in the holdown 42 and an opening in a washer 43. The holdown 42 is affixed to a vertical stud member 44 by bolts 45. A threaded nut 25 is then threaded onto threads 24 of anchor bolt 8 and tightened down. The holdown 42 and its installation to a standard anchor bolt is described in U.S. Pat. No. 4,665,672 granted May 19, 1987 to Commins, Gilb and Littleton.

The anchor bolt connection 1 produced by the method above described reliably produces a stronger connection which may be inspected, before, during, and after the concrete is poured. Actual tests on the anchor bolt connection of the present invention permit 10% better load values to be used.

As examples, an anchor bolt having a ⅝" diameter and a length of 16" with a minimum embedment of 12" in a monolithic pour is rated for a maximum allowable tension load of 4,420 pounds. A 20" anchor bolt with a ⅝" diameter is rated at 4,600 pounds and a ⅞" diameter anchor bolt 28" long with a minimum embedment of 24" has a maximum allowable tension load of 10,100 pounds.

It should be noted that the anchor bolt of the present invention is more resistant to pull out simply due to the fact that there is a minimal length of the anchor bolt 8 which is in a vertical position due to the offset angle 14. The portions of prior art anchor bolts which extend vertically into the foundation provide no mechanical resistance to pull out and resistance to pull out for the vertical portions is totally dependent upon the surface friction between the anchor bolt and the concrete. If under extreme loads, the anchor bolt elongates under tension loads thereby causing a decrease in the diameter of the anchor bolt, the side of the bolt will draw away from the surrounding concrete and all surface friction is lost causing a total loss of pull out resistance in that portion of the anchor bolt. Since all but a minimal portion of the embedded portions of the present anchor bolt 8 are at an angle to the vertical, there is always a mechanical resistance to pull out for all embedded portions of the anchor bolt 8.

Rotation of the anchor bolt 8 to an angular rotational position 35 ensures that all minimum distances of the anchor bolt 8 from the side walls of the foundation will be maintained. An anchor bolt which is too close to the side wall of the foundation will result in premature failure of the anchor bolt connection 1 due to bursting of the concrete under extreme loads. Further, an anchor bolt which is too close to the side of the foundation or which protrudes through the foundation wall will result in premature failure of the connection due to rusting of the anchor bolt.

We claim:

1. An anchor connection between an in sito concrete foundation and a framed building having a generally vertical stud member comprising:

a. a concrete foundation for supporting and anchoring said framed building against design uplift forces substantially parallel to said generally vertical stud members having a top surface, an outer wall face, an inner wall face spaced from said outer wall, and a bottom wall;

b. holdown means connected to said generally vertical stud member, c. an anchor member having:

1. an upper portion extending generally in a vertical direction parallel to said generally vertical stud member and positioned closer to said outer wall face than said inner wall face and connected to said holdown means, and having an upper end and a lower section, 2. a shank portion having an upper section integrally connected to said lower section of said upper end portion of said anchor member substantially embedded in said concrete foundation and having a substantial portion disposed at an offset angle to the axis of said upper end portion and to the direction of said design uplift force and in a direction away from said outer wall face and having a lower section and;

d. an embedded end portion having an upper section integrally connected to said lower section of said shank portion formed to laterally protrude from the axis of said shank portion in a direction away from said outer wall face.

2. An anchor connection as described in claim 1 comprising:

a. said embedded end portion forms a compound curve.

3. An anchor connection as described in claim 2 comprising:

a. said portions of said anchor member lie in substantially the same plane.

4. An anchor connection as described in claim 3 comprising:

a. said anchor member is provided with an embedment indicia mark indicating the embedment level of said anchor bolt in said concrete foundation.

5. An anchor connection as described in claim 4 comprising:

a. said embedment indicia mark is formed in said anchor member at the intersection of said upper portion and said shank portion.

6. An anchor connection as described in claim 5 comprising:

a. said upper portion is formed with a plurality of threads adapted for receiving a threaded nut.

7. An anchor connection as described in claim 1 comprising:

a. orientation indicia means provided on the upper end of said anchor member said anchor member above said embedded portions adapted for visually orienting said anchor member in relation to at least one of said walls of said concrete foundation.

8. In a method for constructing an anchor connection between a framed building having a generally vertical stud member, and a holdown means connected to said generally vertical stud member and an in sito concrete foundation having inner and outer wall faces, which method comprises:

a. forming a foundation space between at least two spaced form members the improvement comprising:

1. introducing an anchor member into said foundation space which is formed with an upper portion extending generally in a vertical direction parallel to said generally vertical stud member for connection to said holdown means and positioned closer to said outer wall than said inner wall, a shank portion embedded in said foundation and disposed at an offset angle to said upper portion away from said outer wall face, and orientation indicia means provided on said anchor member above said embedded portion adapted for visually orienting said anchor bolt in relation to said formed foundation space;

2. selecting an angular rotational position of said anchor member in said foundation space; and 3. holding said anchor member in said selected rotational position while pouring and the setting of said concrete foundation.

* * * * *

UNITED STATES PATENT AND TRADEMARK OFFICE

CERTIFICATE OF CORRECTION

PATENT NO. : 5,317,850

DATED : June 7, 1994

INVENTOR(S) : Karen W. Colonias and Thomas J. Fitzmyers

It is certified that error appears in the above-identified patent and that said Letters Patent is hereby corrected as shown below:

Column 5, line 9, after the words "between an in" change "sito" to ---situ---

Column 6, line 18, after the words "said anchor member" delete "said anchor member"

Column 6, line 25, after the words "member and an in" change "sito" to ---situ---

Signed and Sealed this

Thirtieth Day of August, 1994

*Attest:*

*Attesting Officer*

BRUCE LEHMAN

*Commissioner of Patents and Trademarks*